US008123291B1

(12) United States Patent
Hernandez

(10) Patent No.: US 8,123,291 B1
(45) Date of Patent: Feb. 28, 2012

(54) CHAIR WITH MISTING APPARATUS

(76) Inventor: John Hernandez, Trinity, FL (US)

( * ) Notice: Subject to any disclaimer, the term of this patent is extended or adjusted under 35 U.S.C. 154(b) by 239 days.

(21) Appl. No.: 12/645,658

(22) Filed: Dec. 23, 2009

(51) Int. Cl.
*A47C 7/72* (2006.01)

(52) U.S. Cl. ..... 297/180.15; 297/31; 297/900

(58) Field of Classification Search ..... 297/31, 297/39, 22, 900, 180.15; 239/289, 70, 135, 239/128; D6/491, 330
See application file for complete search history.

(56) References Cited

U.S. PATENT DOCUMENTS

| | | | | | |
|---|---|---|---|---|---|
| 3,625,434 | A | * | 12/1971 | Kitover | 239/289 |
| 4,258,706 | A | * | 3/1981 | Shank | 601/55 |
| 4,765,542 | A | * | 8/1988 | Carlson | 239/289 |
| D297,991 | S | | 10/1988 | Boyle, Jr. | |
| 4,846,525 | A | * | 7/1989 | Manning | 297/180.15 |
| 4,854,502 | A | * | 8/1989 | Cox | 239/124 |
| 4,961,535 | A | * | 10/1990 | Skibik | 239/289 |
| 5,000,384 | A | * | 3/1991 | Arnold | 239/128 |
| 5,027,455 | A | * | 7/1991 | Commisso et al. | 5/421 |
| 5,121,882 | A | * | 6/1992 | Skidmore | 239/269 |
| 5,156,339 | A | * | 10/1992 | Gibson et al. | 239/289 |
| 5,322,342 | A | * | 6/1994 | Gange | 297/180.15 |
| 5,613,731 | A | * | 3/1997 | Aspinall | 297/180.15 |
| 5,823,617 | A | | 10/1998 | Schafer | |
| 6,089,655 | A | | 7/2000 | Colman | |
| 6,158,669 | A | | 12/2000 | Louis | |
| 6,592,049 | B1 | | 7/2003 | Wolput | |
| 7,059,671 | B1 | * | 6/2006 | Coggins | 297/180.14 |
| 7,077,465 | B1 | * | 7/2006 | Calderon | 297/180.15 |
| 7,252,329 | B1 | * | 8/2007 | O'Meally | 297/180.15 |
| 7,654,473 | B2 | * | 2/2010 | Hibberd | 239/289 |

* cited by examiner

*Primary Examiner* — David Dunn
*Assistant Examiner* — Erika Garrett

(57) ABSTRACT

A chair with misting apparatus including a liquid dispenser assembly which provides a plurality of 360-degree adjustable nozzles disposed within the seat and backrest portions of the chair, each nozzle having a flow control switch connected to a tank mounted underneath the chair, the tank supplying liquid to the nozzles via conduit disposed within a channel in both the seat and backrest portions of the chair. Alternative embodiments of the apparatus include either an electric pump or a manual pump, and a non-foldable or foldable chair.

14 Claims, 5 Drawing Sheets

CHAIR WITH MISTING APPARATUS

BACKGROUND OF THE INVENTION

Various types of water misting devices are known in the prior art. However, what is needed is a chair with misting apparatus including a liquid dispenser assembly which provides a plurality of 360-degree adjustable nozzles disposed within the seat and backrest portions of the chair, each nozzle having a flow control switch connected to a tank mounted underneath the chair, the tank supplying liquid to the nozzles via conduit disposed within a channel in both the seat and backrest portions of the chair, and for which alternative embodiments include either an electric pump or a manual pump, and a non-foldable or foldable chair or any combination thereof.

FIELD OF THE INVENTION

The present invention relates to a chair with a water misting apparatus, and more particularly, to a chair with misting apparatus which includes a chair and a liquid dispenser assembly which provides a plurality of 360-degree adjustable nozzles disposed within the seat and backrest portions of the chair, each nozzle having a flow control switch connected to a tank mounted underneath the chair, the tank supplying liquid to the nozzles via conduit disposed within a channel in both the seat and backrest portions of the chair, and with either an electrical or manual pump pumping the liquid from the tank into the nozzles.

SUMMARY OF THE INVENTION

The general purpose of the present chair with misting apparatus, described subsequently in greater detail, is to provide a chair with misting apparatus which has many novel features that result in, a chair with misting apparatus which is not anticipated, rendered obvious, suggested, or even implied by prior art, either alone or in combination thereof. To accomplish this, the present chair with misting apparatus includes a chair and a liquid dispenser assembly which dispenses a mist in a direction relative to the chair. The chair includes a seat portion, a backrest portion, a pair of armrest portions, and legs. The backrest portion may be fixedly attached to the seat portion in one embodiment, but pivotally attached to the seat portion in another embodiment as further described hereinbelow. One of each of the armrest portions is attached between each of the seat portion right side and the seat portion left side and the backrest portion first side and second side, respectively.

The liquid dispenser assembly provides liquid misting spray 360-degree rotatable nozzles mounted to seat portion and to the backrest portion. Each of the nozzles is manually adjustable relative to the chair to change the direction of flow of mist from each of the nozzles. A control switch selectively operationally engages each of the nozzles for manually adjustment of each nozzle to change the amount of mist flowing therefrom in a range from High, Medium, and Low to Off. The adjustability of the control switches allows a user to determine the direction of the mist as well as the amount of mist dispensed from each nozzle. The liquid dispenser assembly also includes an insulated tank, which may be transparent and has a water gauge, attached to the seat portion bottom side adjacent to the backrest portion. The transparency of the tank allows a user to view how much liquid remains in the tank as measured by the water gauge. A drain aperture having a removable drain cap is disposed within a lower wall of the tank to allows the tank to be drained more easily than a drain aperture located elsewhere on the tank, thus allowing a user to replace the tank with fresh liquid. A fill spout, having a spout cap removably disposed over an opening thereto, is disposed on the tank, the fill spout protruding outwardly away from the rearward side of the backrest portion. The position of the fill spout relative to the rearward side of the backrest portion places the fill spout in a position on the tank to allow maximum capacity of liquid to be stored within the tank and allows a user easy access to fill the tank. A cord may be provided to connect the spout cap to the fill spout to prevent the loss of the spout cap.

A sealed electric pump, in operational communication with the tank, is disposed adjacent to the tank on the bottom side of the seat portion. The location of the electric pump on the bottom side of the seat portion protects the electric pump from environmental conditions which are adverse to an electric pump, such as heat, and also hides the electric pump from view, thus making the apparatus more aesthetically pleasing than an apparatus with an visually exposed electric pump. The electric pump circulates liquid from the tank into each of the nozzles. An on-off switch, which alternately activates and deactivates the electric pump, is disposed near the electric pump and the armrest portion. The location of the on-off switch adjacent to the armrest portion allows a user to more easily access the on-off switch while sitting in the chair to more easily activate the apparatus than an on-off switch which is disposed in a location farther away from the backrest portion or as part of a stand-alone dispensing assembly. A waterproof gasket surrounds the on-off switch. The gasket prevents seepage of liquid out of the tank.

A conduit is disposed within a channel disposed within the seat portion and backrest portion of the chair. The conduit runs continuously from the fill spout and operationally interconnects the nozzles with the tank thereby supplying the nozzles with liquid. Because the conduit is disposed within the channel, the conduit is hidden away and is more aesthetically pleasing than conduit attached to the exterior of a chair and thus subject to viewing.

One embodiment of the present apparatus includes a chair which is foldable. The foldable chair includes a front end of the seat portion, a back end of the seat is portion disposed nearer to the backrest portion than the front end, and a midsection disposed between the front end and the back end. A first hinge pivotally attaches the midsection to each of the front end and the back end. A second hinge pivotally attaches the backrest portion to the seat portion which allows the backrest portion to pivot backwardly in an upright position and to pivot forwardly to attain a folded position. A support member runs continuously between the armrest portions adjacent to the rearward side of the backrest portion. The support member supports the backrest portion in an upright position. Thus, the backrest portion selectively folds over the back end and the back end selectively folds over the front end. The foldable embodiment of the chair may also include a foldable leg brace member which is disposed between each of the legs nearest the front end of the seat portion and the bottom side of the seat portion. The leg brace member is foldable so that each of the legs disposed nearest the front end can fold against the bottom side of the seat portion. The foldable chair embodiment allows a user to easily move and store the chair.

To use the present chair with misting apparatus, a user fills the tank by pouring liquid into the fill spout after removing the spout cap. The user replaces the spout cap onto the fill spout after pouring liquid into the tank. The user turns each nozzle in a desired direction relative to the chair. The user also turns each control switch for the desired amount of mist dispensed from each nozzle. To activate and deactivate the liquid dispenser assembly, the user presses the on-off switch alternately. To empty the tank, the user removes the drain cap from the drain aperture. Before filling the tank, the user seals the drain aperture with the drain cap. When using a foldable chair embodiment, to place the backrest portion in an upright position, the user pushes the backrest portion away from the seat portion and toward the support member. To fold the chair, a user folds the backrest portion over the back end of the seat portion, folds leg brace member against the bottom side of the front end and each of the legs nearest the front end toward the bottom side of the front end, and then folds the front end of the seat portion over the backrest portion.

Thus has been broadly outlined the more important features of the present chair with misting apparatus and method so that the detailed description thereof that follows may be better understood and in order that the present contribution to the art may be better appreciated.

Numerous objects, features and advantages of the present chair with misting apparatus will be readily apparent to those of ordinary skill in the art upon reading the following detailed description of presently preferred, but nonetheless illustrative, examples of the present chair with misting apparatus and method when taken in conjunction with the accompanying drawings. In this respect, before explaining the current examples of the present chair with misting apparatus and method in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the chair with misting apparatus and method. It is therefore important that the claims be regarded as including such equivalent constructions insofar as they do not depart from the spirit and scope of the present invention.

Objects of the present chair with misting apparatus and method, along with various novel features that characterize the invention are particularly pointed out in the claims forming a part of this disclosure. For better understanding of the chair with misting apparatus and method, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
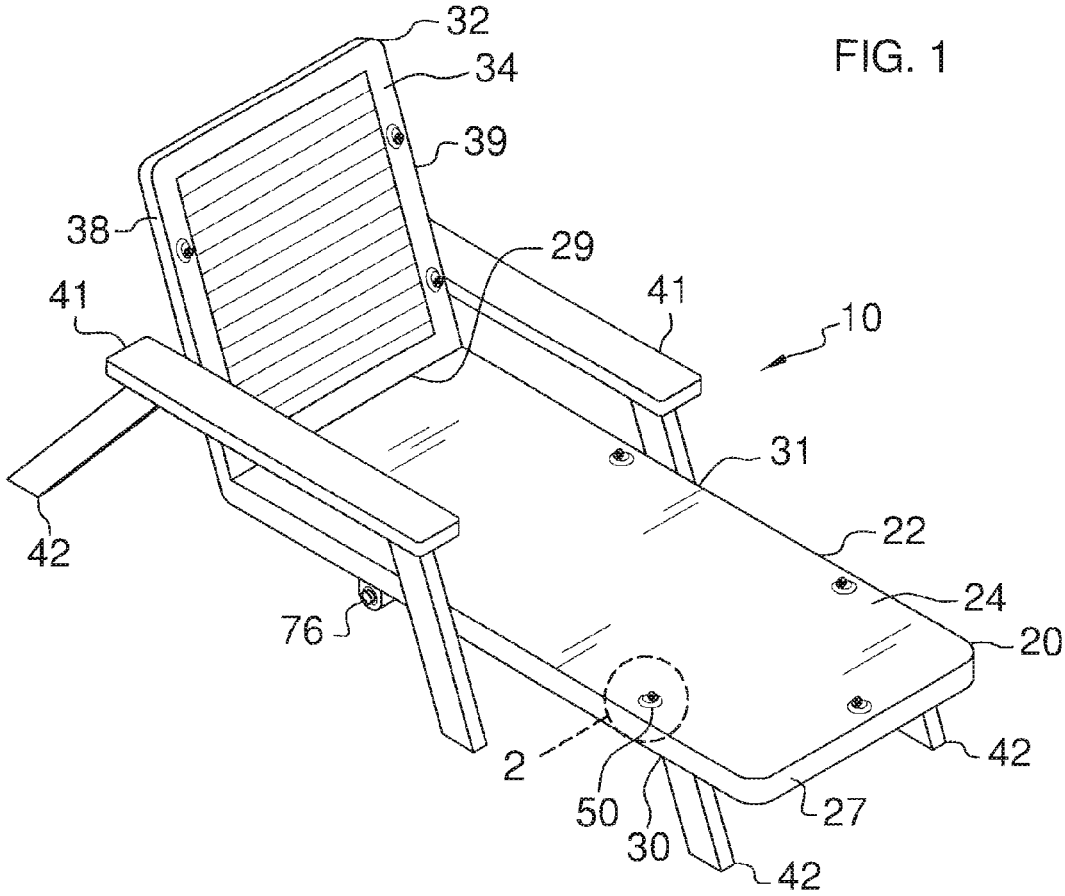
FIG. 1 is an isometric view of the chair.
Figure 2:
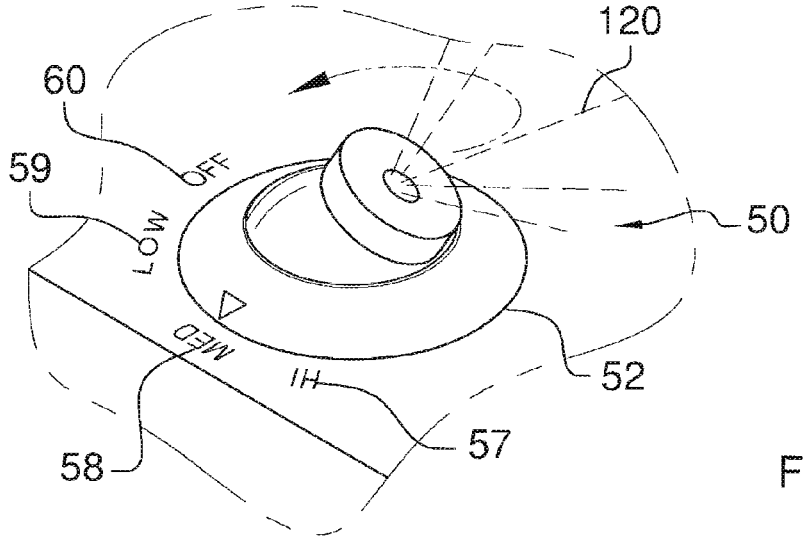
FIG. 2 is an isometric detail view of a nozzle.
Figure 3:
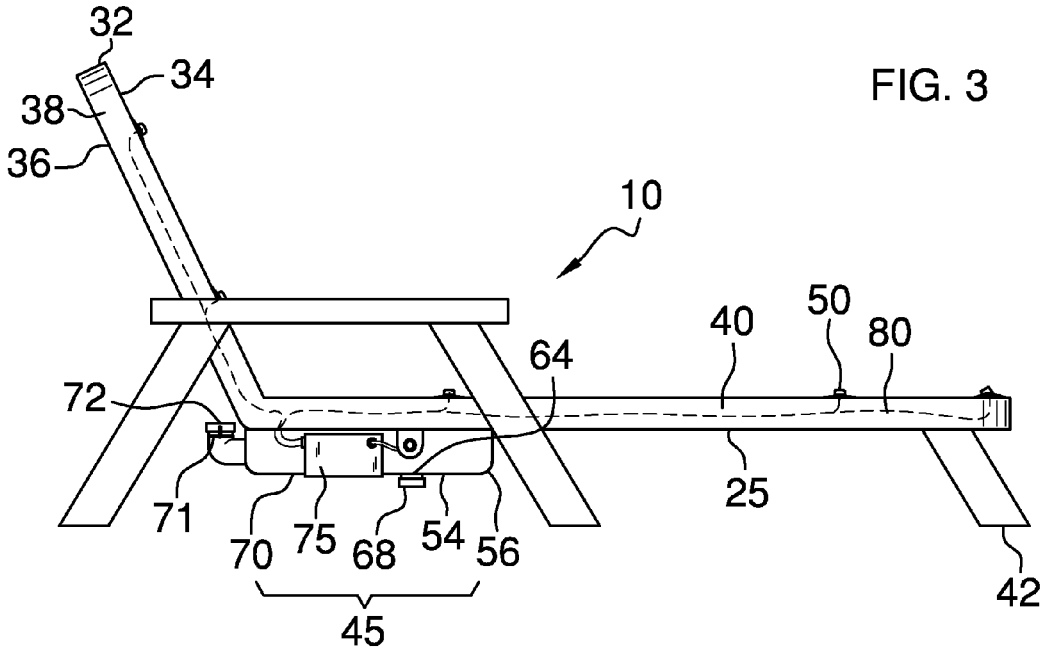
FIG. 3 is a right elevation view of the chair.
Figure 4:
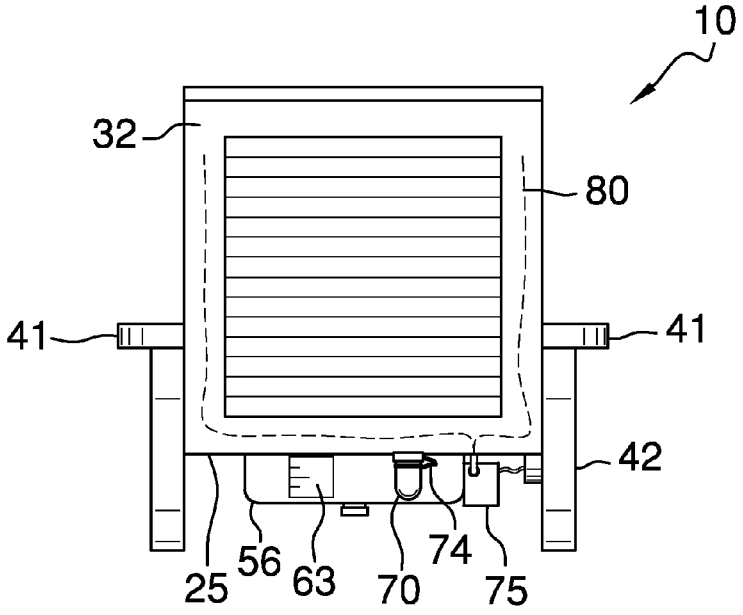
FIG. 4 is a rear elevation view of the chair.
Figure 5:
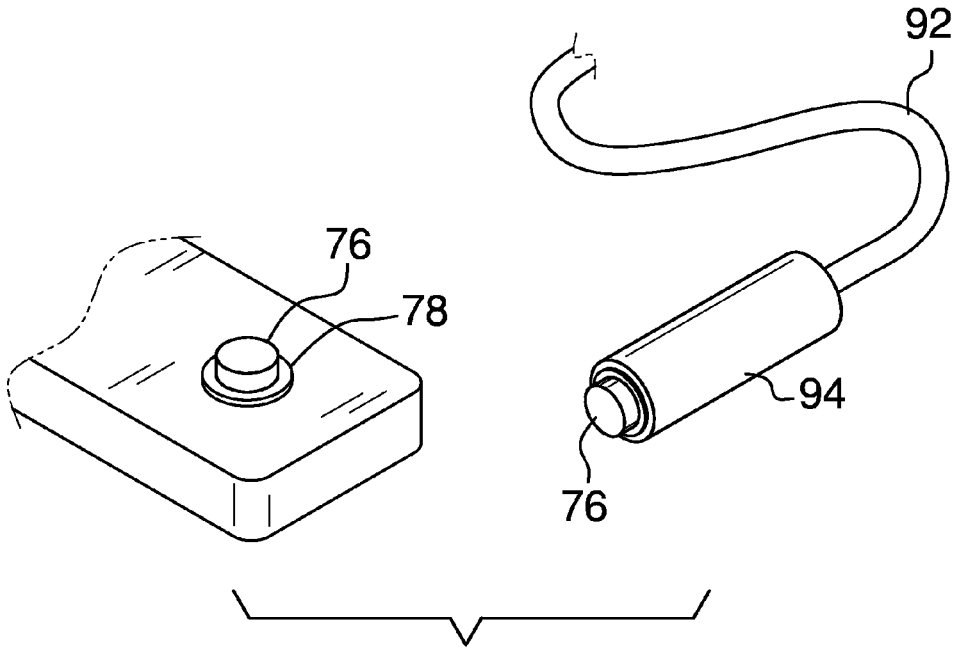
FIG. 5 is an isometric view of a control switch for electric pump and manual pump embodiments.
Figure 6:
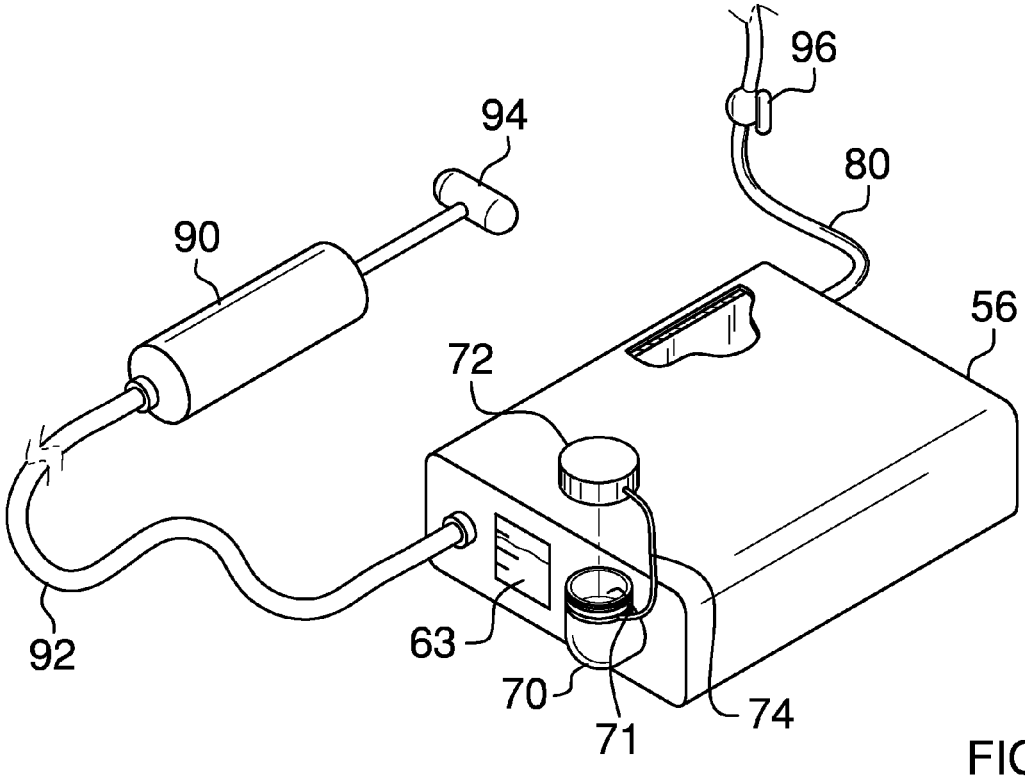
FIG. 6 is an isometric view of an embodiment with a manual pump.

With reference now to the drawings, and in particular FIGS. 1 through 8 thereof, example of the instant chair with misting apparatus employing the principles and concepts of the present chair with misting apparatus and generally designated by the reference number 10 will be described.

Referring to FIGS. 1 through 8, the present chair with misting apparatus 10 is illustrated. The chair with misting apparatus 10 includes a chair 20 and a liquid dispenser assembly 45 which dispenses a mist 120 in a direction relative to the chair 20. The chair 20 includes a seat portion 22, a backrest portion 32 and a pair of armrest portions 41. The seat portion 22 has a top side 24, a bottom side 25, a front side 27, a back side 29, a right side 30, and a left side 31. The backrest portion 32 has a forward side 34, a rearward side 36, a first side 38, and a second side 39. The backrest portion 32 may be fixedly attached to the seat portion 22 in one embodiment, but pivotally attached to the seat portion 22 in another embodiment as further described hereinbelow. A channel 40 is disposed within the seat portion 22 and the backrest portion 32. One of each of the armrest portions 41 is attached between each of the seat portion 22 right side 30 and the seat portion 22 left side 31 and the backrest portion 32 first side 38 and second side 39, respectively. A plurality of legs 42 support the seat portion 22, the backrest portion 32, and each armrest portion 41.

The liquid dispenser assembly 45 includes a plurality of spaced-apart liquid misting spray nozzles 50 mounted to the front side 27, the right side 30, and the left side 31 of the seat portion 22 and to the first side 38 and the second side 39 of the backrest portion 32. Each of the nozzles 50 is manually adjustable relative to the chair 20 to change the direction of flow of mist 120 from each of the nozzles 50. Each of the nozzles 50 is rotatable in 360 degrees.

A control switch 52 selectively operationally engages each of the nozzles 50. Each control switch 52 is manually adjustable relative to each nozzle 50 to change the amount of mist 120 flowing from each nozzle 50. The control switch 52 is also manually adjustable relative to each nozzle 50 to selectively change the amount of flow of mist 120 from each nozzle 50 in a range from High 57, Medium 58, and Low 59 to Off 60. The adjustability of the control switches 52 allows a user to determine the direction of the mist 120 as well as the amount of mist 120 dispensed from each nozzle 50.

The liquid dispenser assembly 45 also includes an insulated tank 56 which is attached to the seat portion 22 bottom side 25 adjacent to the backrest portion 32. The tank 56 may be transparent with a water gauge 63 disposed on the tank 56. The transparency of the tank 56 allows a user to view how much liquid remains in the tank 56 as measured by the water gauge 63. A drain aperture 64 having a removable drain cap 68 is disposed within a lower wall 54 of the tank 56. The location of the drain aperture 64 within the lower wall 54 allows the tank 56 to be drained more easily than a drain aperture 64 located elsewhere on the tank, thus allowing a user to replace the tank 56 with fresh liquid. A fill spout 70 is disposed on the tank 56. The fill spout 70 protrudes outwardly away from the rearward side 36 of the backrest portion 32. The position of the fill spout 70 relative to the rearward side 36 of the backrest portion 32 places the fill spout 70 in a position on the tank 56 to allow maximum capacity of liquid to be stored within the tank 56 and allows a user easy access to fill the tank 56. A spout cap 72 is removably disposed over an opening 71 within the fill spout 70. The fill spout 70 receives liquid therethrough and forwards the liquid to the tank 56. A cord 74 may be provided to connect the spout cap 72 to the fill spout 70 to prevent the loss of the spout cap 72.

A sealed electric pump 75 is disposed adjacent to the tank 56 on the bottom side 25 of the seat portion 22. The electric pump 75 is in operational communication with the tank 56. The location of the electric pump 75 on the bottom side of the seat portion 22 protects the electric pump 75 from environmental conditions which are adverse to an electric pump, such as heat, and also hides the electric pump 75 from view, thus making the apparatus 10 more aesthetically pleasing than an apparatus with an visually exposed electric pump. The electric pump 75 circulates liquid from the tank 56 into each of the nozzles 50. An on-off switch 76 is disposed near the electric pump 75 and the armrest portion 41. The on-off switch 76 is in operational communication with the electric pump 75 and thus, when the on-off switch 76 is pressed, the electric pump is activated or alternately deactivated. The location of the on-off switch 76 adjacent to the armrest portion allows a user to more easily access the on-off switch 76 while sitting in the chair 20 to more easily activate the apparatus 10 than an on-off switch 76 which is disposed in a location farther away from the backrest portion 32 or as part of a stand-alone dispensing assembly. A waterproof gasket 78 surrounds the on-off switch 76. The gasket 78 prevents seepage of liquid out of the tank 56.

A conduit 80 is disposed within the channel 40 within both the seat portion 22 and backrest portion 32 of the chair 20. The conduit 80 runs continuously from the fill spout 70 and operationally interconnects the nozzles 50 with the tank 56 thereby supplying the nozzles 50 with liquid. Because the conduit 80 is disposed within the channel 40, the conduit 80 is hidden away and is more aesthetically pleasing than conduit attached to the exterior of a chair and thus subject to viewing.

One embodiment of the present apparatus 10 substitutes the electric pump 75 with a manual pump 90, which is in operational communication with the tank 56. The manual pump 90 includes a hose 92 connecting the manual pump 90 to the tank 56. A handle 94 is disposed on an opposite end of the manual pump 90 from the hose 92, the handle 94 being in operational communication with the manual pump 90. Pushing the handle 94 toward the manual pump 90 activates the manual pump 90. An on-off switch 76 is disposed on the handle 94, the on-off switch 76 being in operational communication with the manual pump 90. When the manual pump 90 is activated, the manual pump 90 circulates liquid from the tank 56 into each of the nozzles 50. In the manual pump 90 embodiment, the conduit 80 runs from the tank 56 and into the channel 40. The conduit 80 operationally interconnects the nozzles 50 and the tank 56 to supply the nozzles 50 with liquid from the tank 56. A manually-operated valve 96 is disposed on the conduit 80 near the tank 56 wherein the valve 96 controls the flow of liquid from the tank 56 to the nozzles 50.

Figure 7:
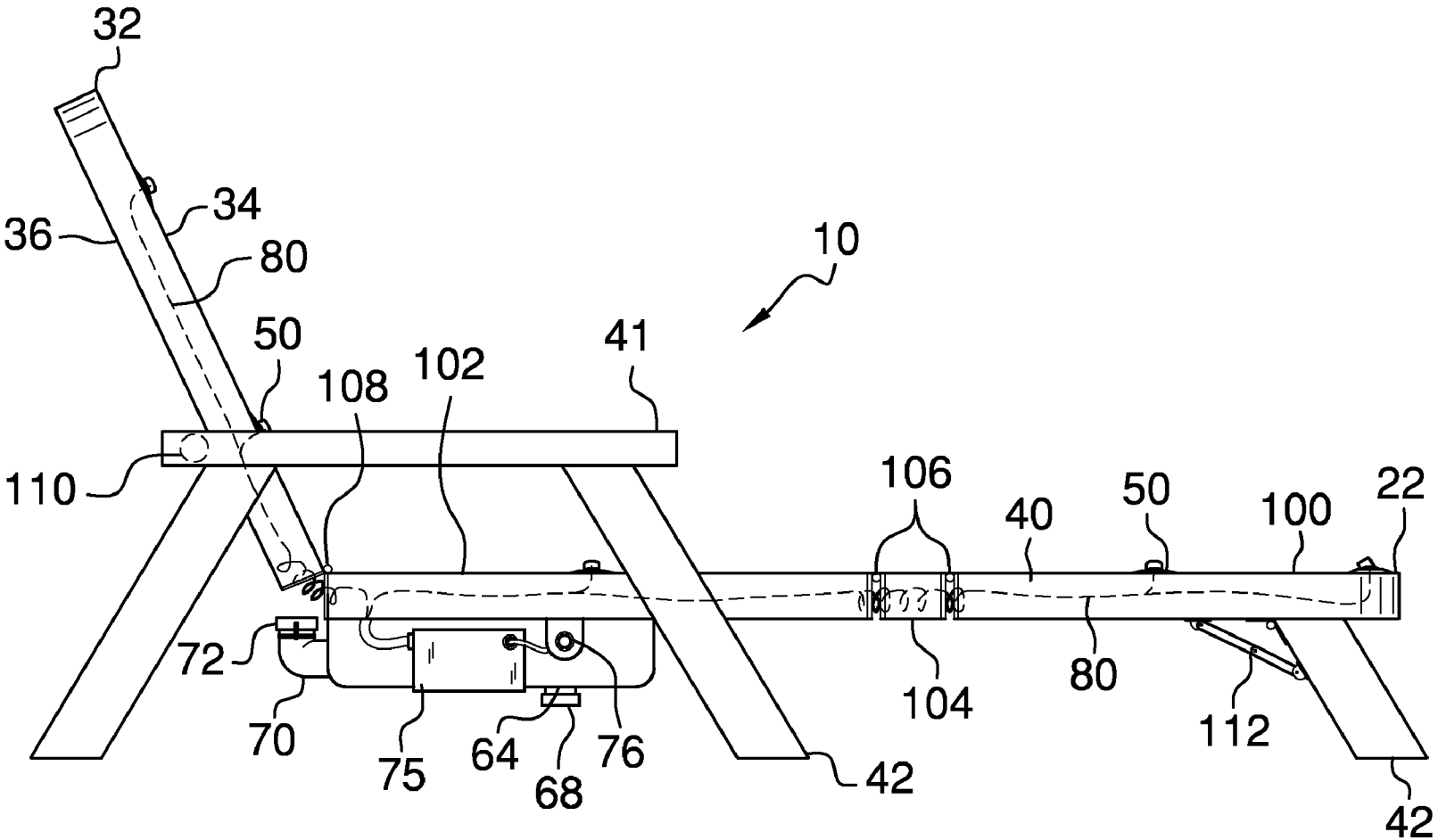
FIG. 7 is a right elevation of a foldable chair embodiment in an extended position.
Figure 8:
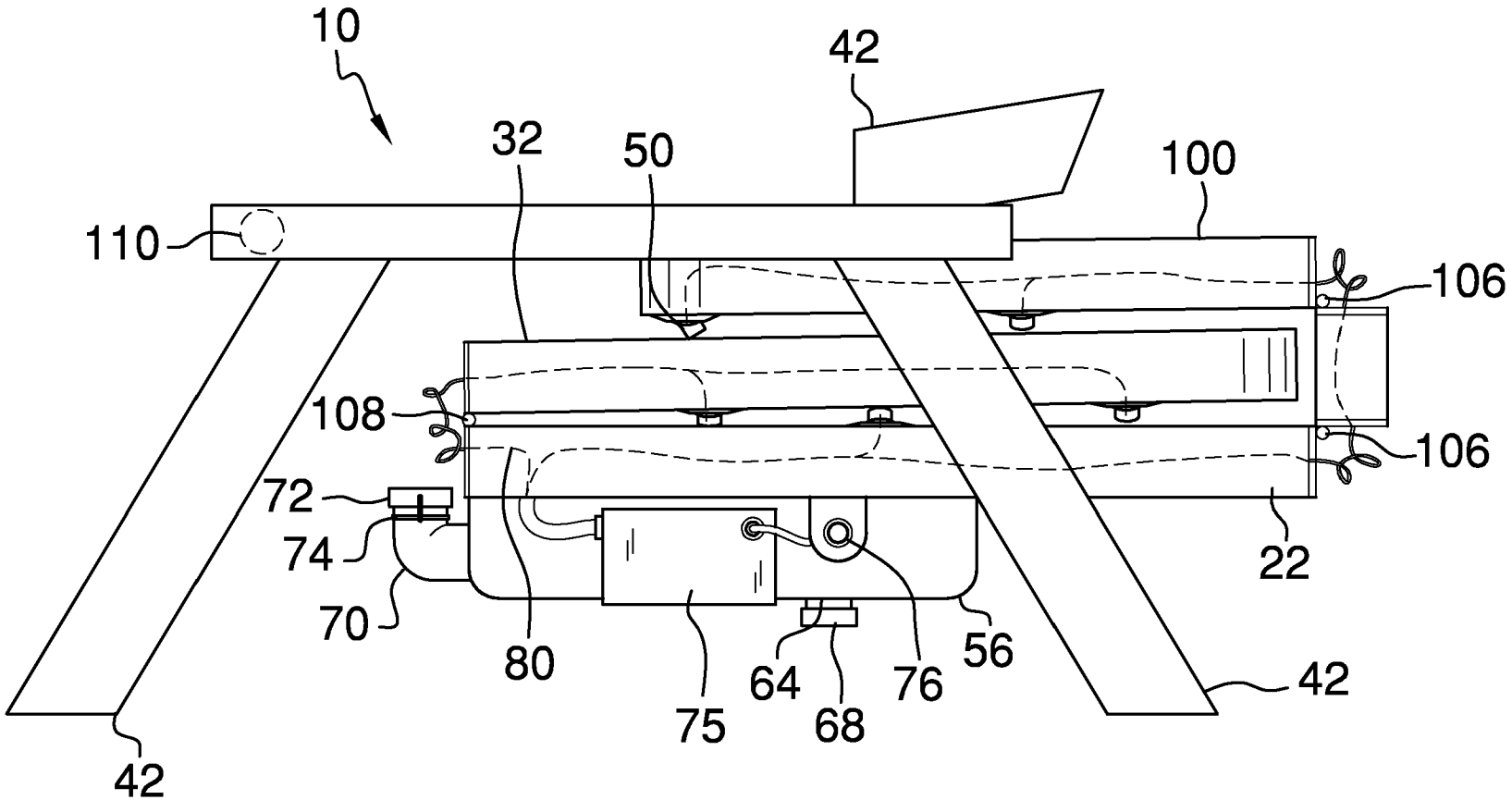
FIG. 8 is a right elevation of a foldable chair embodiment in a folded position.

Another embodiment of the present apparatus 10 includes a chair 20 which is foldable. The foldable chair 20 includes a front end 100 of the seat portion 22, a back end 102 of the seat portion 22 disposed nearer to the backrest portion 32 than the front end 100, and a midsection 104 disposed between the front end 100 and the back end 102. A first hinge 106 pivotally attaches the midsection 104 to each of the front end 100 and the back end 102. A second hinge 108 pivotally attaches the backrest portion 32 to the seat portion 22 which allows the backrest portion 32 to pivot backwardly in an upright position and to pivot forwardly to attain a folded position. A support member 110, which may be cylindrical as shown in FIGS. 7 and 8, runs continuously between the armrest portions 41 adjacent to the rearward side 36 of the backrest portion 32. The support member 110 supports the backrest portion 32 in an upright position. Thus, the backrest portion 32 selectively folds over the back end 102 and the back end 102 selectively folds over the front end 100. The foldable embodiment of the chair 20 may also include a foldable leg brace member 112 which is disposed between each of the legs 42 nearest the front end 100 of the seat portion 22 and the bottom side 25 of the seat portion 22. The leg brace member 112 is foldable so that each of the legs 42 disposed nearest the front end 100 can fold against the bottom side 25 of the seat portion 22. The foldable chair 50 embodiment allows a user to easily move and store the chair 50.

Use:

To use the present chair with misting apparatus 10, a user fills the tank 56 by pouring liquid into the fill spout 70 after removing the spout cap 72. The user replaces the spout cap 72 onto the fill spout 70 after pouring liquid into the tank 56. The user turns each nozzle 50 in a desired direction relative to the chair 20. The user also turns each control switch 52 for the desired amount of mist 120 dispensed from each nozzle to 50. To activate and deactivate the liquid dispenser assembly 45, the user presses the on-off switch 52 alternately. To empty the tank 56, the user removes the drain cap 68 from the drain aperture 64. Before filling the tank 56, the user seals the drain aperture 64 with the drain cap 68.

When using a foldable chair 50 embodiment, to place the backrest portion 32 in an upright position, the user pushes the backrest portion 32 away from the seat portion 22 and toward the support member 110. To fold the chair 50, a user folds the backrest portion 32 over the back end 102 of the seat portion 22, folds leg brace member 112 against the bottom side 25 of the front end 100 and each of the legs 42 nearest the front end 100 toward the bottom side 25 of the front end 100, and then folds the front end 100 of the seat portion over the backrest portion 32.

With respect to the above description then, it is to be realized that the optimum dimensional relationships for the parts of the present chair with misting apparatus to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as “front”, “back”, “in”, “out”, “downward”, “upper”, “lower”, and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A chair in combination with a misting apparatus comprising:

a chair comprising:

a seat portion having a top side, a bottom side, a front side, a back side, a right side, and a left side;

a backrest portion having a forward side, a rearward side, a first side, a second side;

a channel disposed within the seat portion and the backrest portion;

an armrest portion attached between each of the seat portion right side and left side and the backrest portion first side and second side, respectively;

a plurality of legs supporting the seat portion, the backrest portion, and each armrest portion;

a liquid dispenser assembly comprising:

a plurality of spaced-apart liquid misting spray nozzles mounted to the front side, the right side, and the left side of the seat portion and to the first side and the second side of the backrest portion, each of the nozzles dispensing a mist, each of the nozzles manually adjustable relative to the chair to change the direction of mist flow from each of the nozzles;

a control switch selectively operationally engaging each of the nozzles, each control switch manually adjustable relative to each nozzle to change the amount of mist flow from each nozzle;

an insulated tank attached to the seat portion bottom side adjacent to the backrest portion;

a drain aperture having a removable drain cap, the drain aperture disposed within a lower wall of the tank;

a fill spout disposed on the tank protruding outwardly from the rearward side of the backrest portion, wherein the fill spout is disposed on the tank in a position to allow maximum storage capacity;

a spout cap removably disposed over an opening within the fill spout, the fill spout receiving liquid therethrough and forwarding the liquid to the tank;

an electric pump disposed adjacent to the tank, the electric pump in operational communication with the tank, the electric pump circulating liquid from the tank into each of the nozzles;

an on-off switch disposed near the electric pump and the armrest portion, the on-off switch in operational communication with the electric pump;

a waterproof gasket surrounding the on-off switch;

a conduit disposed within the channel, the conduit running continuously from the fill spout operationally interconnecting the nozzles with the tank, wherein the conduit supplies the nozzles with liquid from the tank;

wherein each of the nozzles is rotatable in 360 degrees;

wherein each of the control switches is manually adjustable relative to each nozzle to selectively change the amount of mist flow from each nozzle in a range from High, Medium, and Low to Off;

a water gauge disposed on the tank, wherein the tank is transparent;

a front end of the seat portion;

a back end of the seat portion disposed nearer to the backrest portion than the front end;

a midsection of the seat portion disposed between the front end and the back end a first hinge pivotally attaching the midsection to the front end and to the back end;

a second hinge pivotally attaching the backrest portion to the seat portion, wherein the backrest portion is pivoted backwardly in an upright position and is pivoted forwardly in a folded position;

a support member running continuously between the armrest portions adjacent to the rearward side of the backrest portion, the support member supporting the backrest in an upright position;

wherein the backrest portion folds over the back end, and further wherein the front end folds over the backrest portion.

2. The chair of claim 1 further comprising a foldable leg brace member disposed between each of the legs nearest the front end of the seat portion and the bottom side of the seat portion;

wherein the each of the legs disposed nearest the front end folds against the bottom side of the seat portion.

3. The chair of claim 1 further comprising a cord connecting the spout cap to the fill spout.

4. The chair of claim 2 further comprising a cord connecting the spout cap to the fill spout.

5. A chair in combination with a misting apparatus comprising:

a chair comprising:

a seat portion having a top side, a bottom side, a front side, a back side, a right side, and a left side;

a backrest portion having a forward side, a rearward side, a first side, a second side;

a channel disposed within the seat portion and the backrest portion;

an armrest portion attached between each of the seat portion right side and left side and the backrest portion first side and second side, respectively;

a plurality of legs supporting the seat portion, the backrest portion, and each armrest portion;

a liquid dispenser assembly comprising:

a plurality of spaced-apart liquid misting spray nozzles mounted to the front side, the right side, and the left side of the seat portion and to the first side and the second side of the backrest portion, each of the nozzles manually adjustable relative to the chair to change the direction of mist flow from each of the nozzles;

a control switch selectively operationally engaging each of the nozzles, each control switch manually adjustable relative to each nozzle to change the amount of mist flow from each nozzle;

an insulated tank attached to the seat portion bottom side adjacent to the backrest portion;

a drain aperture having a removable drain cap, the drain aperture disposed within a lower wall of the tank;

a fill spout disposed on the tank protruding outwardly from the rearward side of the backrest portion, wherein the fill spout is disposed on the tank in a position to allow maximum storage capacity;

a spout cap removably disposed on the fill spout, the fill spout receiving liquid therethrough and forwarding the liquid to the tank;

a manual pump in operational communication with the tank, the manual pump comprising a hose connecting the pump to the tank;

a handle disposed on an opposite end of the manual pump from the hose, the handle in operational communication with the manual pump;

an on-off switch disposed on the handle, the on-off-switch in operational communication with the manual pump;

wherein the manual pump circulates liquid from the tank into each of the nozzles;

a conduit running from the tank and into the channel, the conduit operationally interconnecting the nozzles and the tank, wherein the conduit supplies the nozzles with liquid from the tank; and a manually-operated valve disposed on the conduit near the tank wherein the valve controls the flow of liquid from the tank to the nozzles.

6. The chair of claim 5 wherein each of the nozzles is rotatable in 360 degrees.

7. The chair of claim 6 wherein each of the control switches is manually adjustable relative to each nozzle to selectively change the amount of mist flow from each nozzle in a range from High, Medium, and Low to Off.

8. The chair of claim 7 further comprising a water gauge disposed on the tank, wherein the tank is transparent.

9. The chair of claim 8 further comprising a cord connecting the spout cap to the fill spout.

10. The chair of claim 8 wherein the backrest portion is in a fixedly attached to the seat portion.

11. The chair of claim 10 further comprising a cord connecting the spout cap to the fill spout.

12. The chair of claim 10 further comprising a front end of the seat portion;

a back end of the seat portion disposed nearer to the backrest portion than the front end;

a midsection of the seat portion disposed between the front end and the back end a first hinge pivotally attaching the midsection to the front end and to the back end;

a second hinge pivotally attaching the backrest portion to the seat portion, wherein the backrest portion is pivoted backwardly in an upright position and is pivoted forwardly in a folded position;

a support member running continuously between the armrest portions adjacent to the rearward side of the backrest portion, the support member supporting the backrest portion in an upright position;

wherein the backrest portion folds over the back end, and further wherein the front end folds over the backrest portion.

13. The chair of claim 12 further comprising a foldable leg brace member disposed between each of the legs nearest the front end of the seat portion and the bottom side of the seat portion;

wherein the each of the legs disposed nearest the front end folds against the bottom side of the seat portion.

14. The chair of claim 12 further comprising a cord connecting the spout cap to the fill spout.

* * * * *